United States Patent [19]

Todd

[11] Patent Number: 4,921,750

[45] Date of Patent: May 1, 1990

[54] PAPERMAKER'S THRU-DRYER EMBOSSING FABRIC

[75] Inventor: Jeffrey L. Todd, Summerville, S.C.

[73] Assignee: Asten Group, Inc., Charleston, S.C.

[21] Appl. No.: 198,475

[22] Filed: May 25, 1988

[51] Int. Cl.[5] ..... D03D 3/00

[52] U.S. Cl. ..... 428/225; 139/383 A; 162/DIG. 1; 428/247; 428/257

[58] Field of Search ..... 428/233, 236, 257, 225, 428/247; 139/383 R, 383 AA; 162/358, DIG. 1

[56] References Cited

U.S. PATENT DOCUMENTS

| | | | |
|---|---|---|---|
| 4,071,050 | 1/1978 | Codorniu | 139/383 R |
| 4,086,941 | 5/1978 | Thompson | 139/387 R |
| 4,196,248 | 4/1980 | Dutt | 428/236 |
| 4,261,392 | 4/1981 | Westhead | 139/383 A |
| 4,351,874 | 9/1982 | Kirby | 428/229 |
| 4,356,225 | 10/1982 | Dufour | 428/234 |
| 4,461,803 | 7/1984 | Booth et al. | 428/234 |
| 4,469,142 | 9/1984 | Harwood | 139/383 A |
| 4,528,239 | 7/1985 | Trokhan | 428/247 |
| 4,533,594 | 8/1985 | Bachman | 428/236 |
| 4,537,816 | 8/1985 | Booth et al. | 428/234 |
| 4,636,426 | 1/1987 | Fleischer | 428/257 |
| 4,759,976 | 7/1988 | Dutt | 428/257 |

*Primary Examiner*—James J. Bell

*Attorney, Agent, or Firm*—Volpe and Koenig

[57] ABSTRACT

A papermaker's fabric is disclosed. The fabric is comprised of at least top and bottom machine direction yarn systems, each machine direction yarn system being formed of a plurality of yarns which defines a respective top or bottom plane of machine direction yarns. The yarns of the systems are vertically aligned and the top and bottom planes are parallel. A cross machine direction yarn system is interwoven with the machine direction yarn systems in a repeated pattern encompassing at least four adjacent top plane machine direction yarns, with the fabric top plane having an open area of at least 40% and the fabric having an air permeability of at least 900 CFM. The fabric as a substrate has special utility for an embossing fabric.

2 Claims, 2 Drawing Sheets

PAPERMAKER'S THRU-DRYER EMBOSSING FABRIC

BACKGROUND OF THE INVENTION

1. Field of the Invention

This invention relates to a multilayer or duplex papermaking fabric having a high open area. In particular, the invention relates to a papermaking fabric which is suitable as the base or supporting fabric for an embossing papermakers fabric and has a top plane surface with an open area of at least forty-percent (40%).

2. Backqround of the Art

Disposable paper products, such as towels, facial tissues, sanitary tissues, wipers and the like are made from one or more layers or webs of tissue paper. As such disposable products have grown in use, it has become desirable to enhance certain physical characteristics. Among the most important characteristics of the disposable paper products are strength, softness or feel and absorbency.

In producing such products, the papermaking fabric will have a substantial impact on the final product characteristics. In the present state of the art, fabrics which are known as embossing fabrics are utilized to produce many of the products. Embossing fabrics are generally comprised of a base or substrate fabric which has been modified through the application of a material which forms a paper contact surface. Such materials are generally curable resins. The resin material is applied to the fabric to produce certain geometric forming surfaces which will impart the fabric characteristics. In one process for producing the embossing fabric, the fabric is coated with a liquid photosensitive resin to a preselected value or thickness. The resin is exposed to light, having an activating wave length, through a mask which develops a pattern on the paper carrying surface. Uncured resin is removed from the fabric and the resulting embossing fabric will have a specific preselected geometry. One prior art example of such a process is set forth in U.S. Pat. 4,528,239, the specification of which is incorporated herein by reference as if fully set forth.

SUMMARY OF THE INVENTION

The present invention sets forth an improved papermaker's fabric which is particularly useful as a substrate in the embossing fabric art.

The improved fabric is characterized by having at least two systems of machine direction yarns which are arranged in a vertical stacked arrangement. Cross machine direction yarns are preferably interwoven with the machine direction yarns to establish a symmetric weave and to avoid unbalanced forces on the machine direction yarns. The cross machine direction yarns are further woven so as to lock the machine direction yarns against horizontal and vertical movement in the fabric. The woven fabric will have a top plane with an open area of at least forty-percent (40%). That is to say, the interstices between the interwoven yarns will total at least 40% of the total fabric surface area.

DETAILED DESCRIPTION OF THE INVENTION

Figure 1:
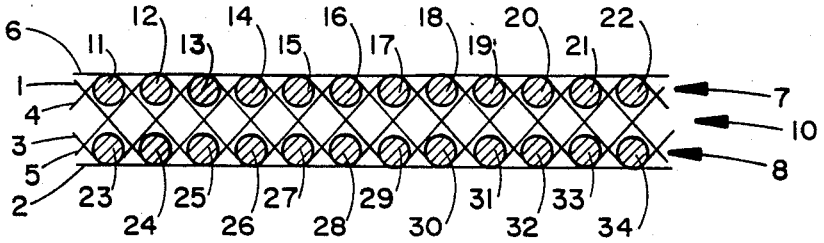
FIG. 1 is a section cut through the machine direction yarns and parallel to the cross machine direction yarns of the preferred embodiment of the invention.

While the specification will employ certain terms for the purposes of description, it will be understood that the art recognizes alternative terms for the same element and that such alternative terms are intended to be within the scope of the claims appended hereto. Likewise terms, such as upper, lower, left and right, are used relative to the drawing figures and are not intended as absolute directions. The terms "machine direction" and "cross machine direction" refer to the direction of use and not the loom designation of the respective yarns. Fabrics according to the invention may be woven flat or endless and with or without seams. In each of the drawing figures, like elements are identified with the same numeral.

With reference to FIG. 1, there is shown a fabric 10 which is of a duplex or multilayer construction. The fabric 10 is comprised of a first system 7 of machine direction yarns 11 through 22, a second system 8 of machine direction yarns 23 through 34, and a system of cross machine direction yarns 1 through 6. The machine direction yarns 11 through 22 which comprise the system 7 are vertically stacked above the machine direction yarns 23 through 34 which comprise system 8. In the present specification, the term "stacked" means that a machine direction yarn of system 7 and the associated machine direction yarn of system 8 are in the same vertical plane. Likewise, all of the yarns within machine direction systems 7 and 8 are parallel to each other and lie in a respective common horizontal plane. This relationship will be discussed further hereinafter with respect to FIG. 7. The cross machine direction yarns are interwoven in a pattern of two over and four under. Those skilled in the art will recognize that twelve harnesses are utilized to produce the weave pattern.

With reference to FIGS. 2 through 6, it can be seen that the cross machine direction yarns are interwoven in a pattern which will produce a plurality of floats and interlacings which sequentially isolate and lock a given machine direction yarn in a preselected position. Furthermore, it can be seen that the weave pattern produces a fabric having an upper or top surface and a lower or bottom surface which are essentially mirror images of each other.

Figure 2:
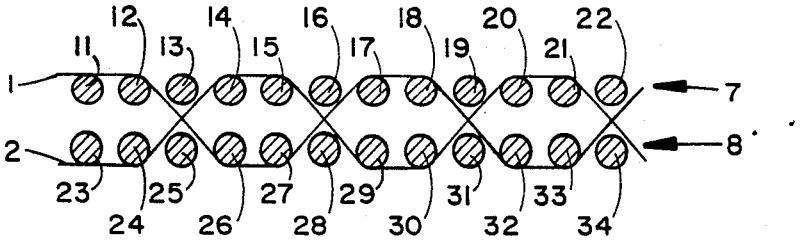
FIG. 2 is an illustration showing the interweaving of the first and second cross machine direction yarns in the weave of FIG. 1.

With reference to FIG. 2, cross machine direction yarn, as it progresses to the right, floats above machine direction yarns 11 and 12 then turns downward to pass between machine direction yarns 13 and 25 and under machine direction yarn s 26 and 27. Cross machine direction yarn 1 then turns upwardly between machine direction yarns 16 and 28. Thereafter, cross machine direction yarn 1 will repeat the interweaving with systems 7 and 8. Cross machine direction yarn 2 weaves in the mirror image of cross machine direction 1.

Figure 3:
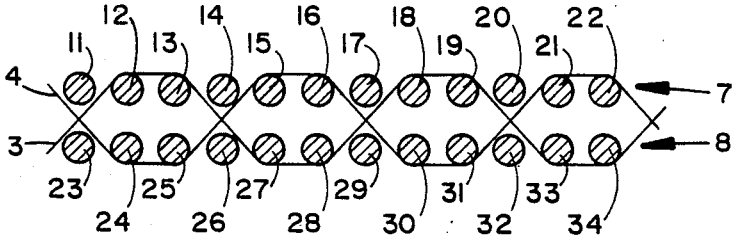
FIG. 3 is an illustration of the interweaving of cross machine direction yarns 3 and 4 in the weave of FIG. 1.

With reference to FIG. 3, cross machine direction yarn 3, as it progresses to the right, passes between machine direction yarns 11 and 23, over machine direction yarns 12 and 13, between machine direction yarns 14 and 26 and under machine direction yarns 27 and 28. Beginning with machine direction yarns 17 and 29, cross machine direction yarn 3 repeats the pattern. Cross machine direction yarn 4 weaves in the mirror image of cross machine direction yarn 3.

Figure 4:
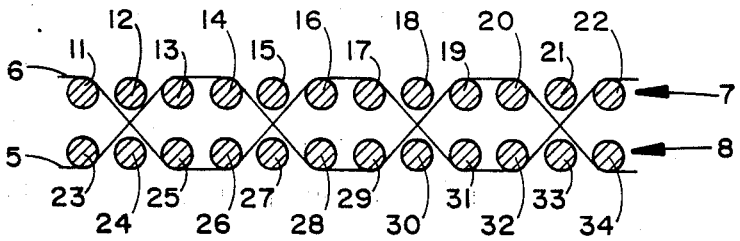
FIG. 4 is an illustration of the interweaving of cross machine direction yarns 5 and 6 in the weave of FIG. 1.

With respect to FIG. 4, cross machine direction yarn 5, as it progresses to the right, interweaves between machine direction yarns 12 and 24, over machine direction yarns 13 and 14, down between machine direction yarns 15 and 27 and beneath machine direction yarns 28 and 29 before repeating the pattern. Cross machine direction yarn weaves in the mirror image of cross machine direction yarn 5.

As can be seen from the above, the pattern and sequencing of interweaving produces a structure in which the cross machine direction yarns weave over under and across each of the machine direction yarns in a pattern which isolates and interlocks the respective machine direction yarn. By weaving the cross machine direction yarn in a symmetric weave, it is possible to avoid uneven forces on the machine direction yarns and to lock the yarns against both vertical and horizontal movement. In the final weave structure, the machine direction yarns are effectively straight throughout their length with the majority of the take up and most of the crimp concentrated in the cross machine direction yarns.

Figure 5:
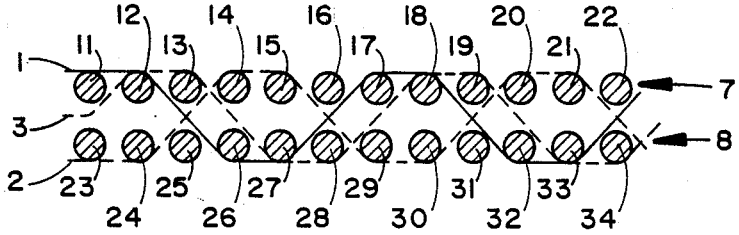
FIG. 5 is an illustration of the interweaving of cross machine direction yarns 4, 5 and 6 of the weave of FIG. 1.
Figure 6:
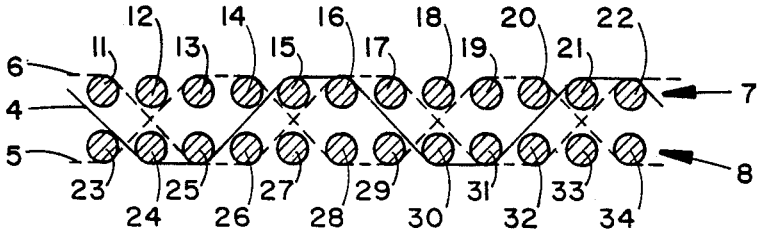
FIG. 6 is an illustration of the interweaving of cross machine direction yarns 4, 5 and 6 of the weave of FIG. 1.

With reference to FIGS. 5 and 6, it is possible to see the locked position of the machine direction yarns according to the invention. With reference to FIG. 5 and machine direction yarn 13, it can be seen that cross machine direction yarn 1 passes along side and beneath the left hand portion of yarn 13; cross machine direction yarn passes along side and beneath the right hand portion of yarn 13 and cross machine direction yarn 3 passes over the top of machine direction yarn 13 In the final weave, cross machine direction yarns 1 through serve to capture and position machine direction yarn 13. With reference to FIG. 6, it can be seen that the interweaving of cross machine direction yarns 4, 5 and 6 do not capture machine direction yarn 13. However, the machine direction yarn 24 is captured by the interweaving of cross machine direction yarns 4 through 6 in a manner similar to that previously described with respect to FIG. 5.

Figure 7:
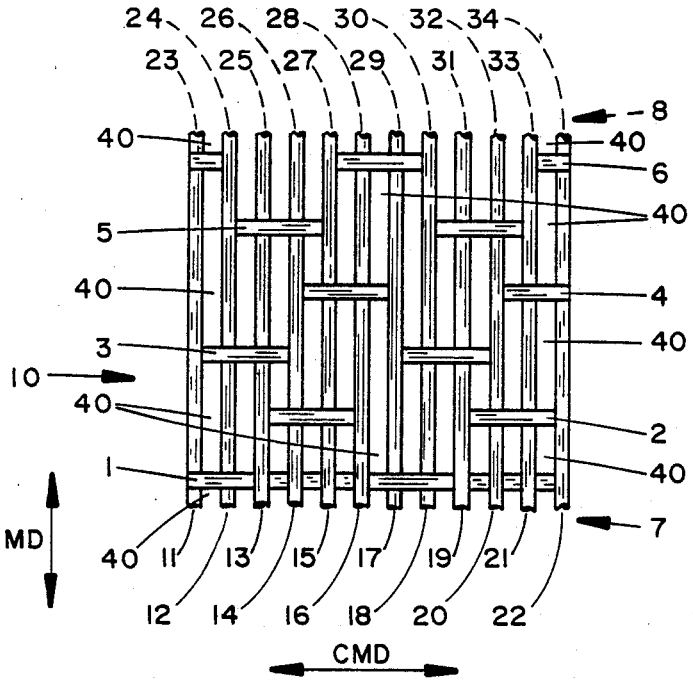
FIG. 7 is a top plan view of one repeat of the fabric according to the weave of FIG. 1.

With reference to FIG. 7, the weave structure of FIG. 1 can be further understood. As noted previously, the weave is a twelve harness weave and the cross machine direction yarns are woven in a two, four twill pattern. In the top plan view of FIG. 7, the machine direction yarns of system 7 along with the upper floater of cross machine direction yarns 1 through 6 will form the upper or top fabric surface. The machine direction yarns of system 8 will be aligned vertically below the machine direction yarns of system 7 and are indicated by the phantom lead lines. It will be understood by those skilled in the art that the interweaving of the cross machine direction yarns 1 through 6 with the machine direction yarns of system 8 will be partially visible when the fabric is viewed from the top plan as shown in FIG. 7. For purposes of clarity and description, only cross machine direction yarn 1 has been fully illustrated. All other cross machine direction yarns are illustrated as they would appear in the top plane.

Further with reference to FIG. 7, it can be seen that the described weave structure provides a number of interstices 40. In order to achieve the minimum open area of forty-percent (40%) according to the invention, the total area of interstices 40 must equal at least 40% of the surface area of the fabric. In the preferred embodiment, the machine and cross machine direction yarns are 5.91 mils or 0.15 mm and the fabric is woven with a mesh count of 60.

Figure 8:
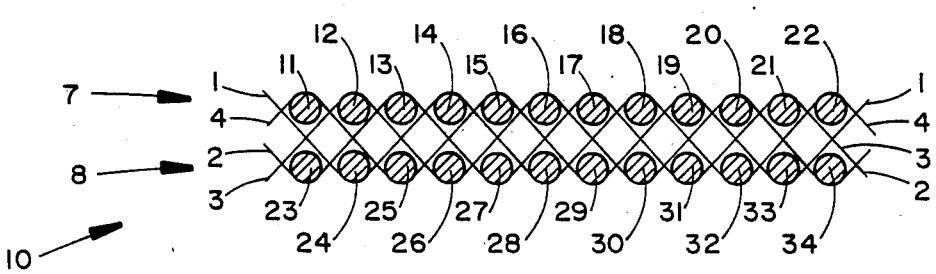
FIG. 8 is a section of an alternative embodiment of the invention in a different weave pattern from that shown in FIG. 1.

With reference to FIG. 8, there is shown an alternative embodiment of the fabric according to the invention woven on eight harnesses in a one, three repeat pattern. Thus, the length of the repeat pattern encompasses at least four adjacent top layer machine direction yarns. The machine direction systems 7 and 8 will be as shown previously and the interweaving of cross machine direction yarns 1 through is illustrated in a manner similar to FIG. 1.

Figure 9:
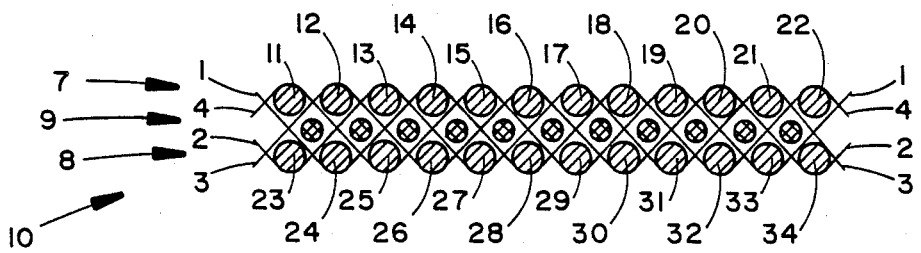
FIG. 9 is an illustration of the weave of FIG. 8 with the addition of stuffer yarns.

With reference to FIG. 9, there is shown another alternative embodiment of the fabric 10 according to the instant invention. In FIG. 9, the weave is a twelve harness weave which incorporates the addition of a stuffer system 9 of machine direction yarns. Like FIG. 8 the repeat pattern is one, three and the interweaving of cross machine direction yarns 1 through 4 is illustrated. Once again, the upper and lower planes of the fabric are mirror images. The stuffer yarns, like the other machine direction yarns are captured and maintained in place by the cross machine direction weave. In general, the stuffer yarns will be of substantially smaller diameter than the machine direction yarns and will be used to control the air permeability of the fabrics. Although it is critical to maintain the open area of at least 40% in the top fabric plane, it is also necessary to control air permeability through the fabric.

Generally, air permeability in fabrics according to the invention is greater than 900 CFM and is preferably in the range of 1,000 to 1,300 CFM. Air permeability is measured on the Frazier High Pressure Differential Permeability Testing Machine which will be known to those skilled in the art.

With respect to the fabric caliper, it is preferred that the substrate fabric have a caliper of about 24 mils. Although fabrics as high as 29 mils have been tried, it has been found that base fabrics in excess of about 26 mils hamper the curing process associated with the resin coating which may be applied to the fabric 10 when used as a substrate for an embossing fabric.

As can be seen from the foregone, it is necessary to utilize a cross machine direction weave pattern which captures and vertically stacks the machine direction yarn. This weave structure must accomplish a minimum top layer or plane open area of 40% and must provide the required air permeability through the fabric of about at least 900 CFM. Fabrics according to the instant invention are suitable for resin coating in accordance with the disclosure of U.S. Pat. 4,528,239.

What I claim is:

1. A papermaker's substrate for combination with a resinous, patterned paper contacting surface to produce an embossing fabric, said substrate comprised of at least top and bottom machine direction yarn systems, each machine direction yarn system being formed of a plurality of yarns which defines a respective horizontal plane of machine direction yarns, said systems being vertically aligned with each other and said respective horizontal planes being parallel; a cross machine direction yarn system which is interwoven with said machine direction yarn systems, and maintains the respective machine direction yarns substantially within their respective planes and in vertical alignment; and an open area of at least 40% in the top plane with a substrate air permeability of at least 900 CFM.

2. An embossing fabric comprised of a substrate fabric and a resinous material defining a patterned paper contacting surface, said substrate fabric further comprised of at least top and bottom machine direction yarn systems, each machine direction yarn system being formed of a plurality of yarns which define a respective plane of machine direction yarns, said respective planes being parallel and said yarn systems being vertically aligned with each other; and a cross machine direction yarn system interwoven with said machine direction yarn systems in a repeated pattern with the respective machine direction yarns substantially within their respective planes and in vertical alignment, said substrate fabric having a top plane open area of at least 40% and air permeability of at least 900 CFM.

* * * * *

UNITED STATES PATENT AND TRADEMARK OFFICE

CERTIFICATE OF CORRECTION

PATENT NO. : 4,921,750

DATED : May 1, 1990

INVENTOR(S) : Jeffrey L. Todd

It is certified that error appears in the above-identified patent and that said Letters Patent is hereby corrected as shown below:

Column 2, line 9, delete "4, 5 and 6" and insert --1, 2 and 3--.

Column 3, line 3, delete the word "yarn s" and insert --yarns--.

Column 3, line 48, after the numeral "13" insert --.--.

Column 3, line 49, after the word "through" insert the numeral --3--.

Column 4, line 25, after the word "through" insert the numeral --4--.

Signed and Sealed this

Twentieth Day of August, 1991

*Attest:*

HARRY F. MANBECK, JR.

*Attesting Officer*

*Commissioner of Patents and Trademarks*